United States Patent [19]

Merkenich et al.

[11] Patent Number: 4,517,109

[45] Date of Patent: May 14, 1985

[54] PROCESS FOR MAKING MIXED GRANULATES FROM CONDENSED PHOSPHATES AND BUILDER SALTS

[75] Inventors: Karl Merkenich, Rimbach; Horst-Dieter Wasel-Nielen, Hürth; Alexander Maurer, Hürth; Renate Adrian, Hürth, all of Fed. Rep. of Germany

[73] Assignee: Hoechst Aktiengesellschaft, Fed. Rep. of Germany

[21] Appl. No.: 542,075

[22] Filed: Oct. 14, 1983

Related U.S. Application Data

[63] Continuation of Ser. No. 359,380, Mar. 18, 1982, abandoned.

[30] Foreign Application Priority Data

Mar. 25, 1981 [DE] Fed. Rep. of Germany ..... 3111617

[51] Int. Cl.[3] ..... C11D 3/06; C11D 7/16

[52] U.S. Cl. ..... 252/135; 252/174.13; 252/174.24; 252/527; 252/546

[58] Field of Search ..... 252/135, 174.13, 174.24, 252/527, 546

[56] References Cited

U.S. PATENT DOCUMENTS

| | | | |
|---|---|---|---|
| 2,904,513 | 9/1959 | Metcalf | 252/135 |
| 3,627,686 | 12/1971 | Sabatelli et al. | 252/135 |
| 3,775,315 | 11/1973 | Smith et al. | 252/135 |
| 4,077,897 | 3/1978 | Gault | 252/135 |
| 4,228,025 | 10/1980 | Jacobsen | 252/174.13 |
| 4,394,359 | 7/1983 | Wasel-Nielen et al. | 423/305 |

*Primary Examiner*—Paul Lieberman
*Assistant Examiner*—Robert A. Wax
*Attorney, Agent, or Firm*—Connolly and Hutz

[57] ABSTRACT

The disclosure provides a process for making mixed granulates from water-soluble condensed phosphates and at least one builder salt by subjecting the components making the granulate to granulation in the presence of water. To this end, the disclosure provides:

(a) for water to be sprayed on to a mixture of the condensed phosphate, the builder salt and an ammonium polyphosphate as a binder, and for the mixture to be granulated, or (b) for an aqueous solution or suspension of ammonium polyphosphate to be sprayed on to the mixture of condensed phosphate and builder salt, and for the mixture to be granulated.

6 Claims, No Drawings

PROCESS FOR MAKING MIXED GRANULATES FROM CONDENSED PHOSPHATES AND BUILDER SALTS

This application is a continuation of our copending application Ser. No. 359,380, filed Mar. 18, 1982 and now abandoned.

The present invention relates to a process for making mixed granulates from water-soluble condensed phosphates of the general formula $M_2O(MPO_3)_n$, in which M stands for sodium, potassium or ammonium and n stands for a number between 4 and about 100, and builder salts. The condensed phosphates contain 60.4 up to 69.6% $P_2O_5$.

It has been described that water-soluble condensed phosphates of the above general formula, which are also termed melt phosphates, should be used as ingredients of detergent and cleaning compositions. Such cleaning compositions have been disclosed, for example in European Patent Application Nos. 79 302 058.7 and 79 302 059.5. The use e.g. of condensed alkali metal phosphates in detergent compositions has turned out advantageous inasmuch as they combine a good power for sequestering lime with a good capacity for suspending or peptizing dirt, and with good emulsifying properties. An adverse effect of these compounds resides in their hygroscopicity so that detergents having melt phosphates incorporated therewith are liable to absorb atmospheric moisture and to coalesce during storage. In European Patent Application No. 79 302 058.7, attempts have been made to avoid this deficiency and it has been suggested that the detergents be placed in packages impermeable to moisture.

Further attempts to render water-soluble melt phosphates less sensitive to moisture have been described in U.S. Pat. No. 2,568,110, wherein it is suggested that the melt phosphate should be granulated by intensively mixing an aqueous about 20 to 65 weight % solution of the melt phosphate with an anhydrous hydratable substance, e.g. sodium carbonate, disodium hydrogen phosphate or pentasodium triphosphate. The resulting mixture contains about 5 to 45% melt phosphate, 20 to 90% anhydrous substance, the balance being water, for which it is, however, obligatory to be used in the proportion necessary to ensure that the final mixture constitutes a solid product. The mixing ratios just referred to indicate that the mixture contains relatively low proportions of melt phosphate but a high proportion of anhydrous substance. In the event of $Na_2CO_3$ being used as the anhydrous substance, the mixture is rendered highly alkaline whereby its uses in the detergent fields become very limited. In the event of the $Na_2CO_3$ being replaced e.g. by pentasodium triphosphate, the total phosphate content becomes increased to an undesirable extent. In the end, mixtures are obtained which are unsuitable for use in detergent compositions of reduced phosphate content.

It is therefore highly desirable to prepare mixed granulates comprised of condensed phosphates and builder salts with the use of a minimum of granulating aids which do not adversely affect the surface-active properties of the condensed phosphate, the granulates being flowable, storable and abrasion-resistant so that it is possible for them to be added as a detergent ingredient to a hot spray base product.

The present invention relates more particularly to a process for making mixed granulates from water-soluble condensed phosphates of the following general formula (I)

$$M_2O(MPO_3)_n \quad (I)$$

in which M stands for sodium, potassium or ammonium and n stands for a number between 4 and about 100, and at least one builder salt by subjecting the components making the granulate to granulation in the presence of water, which comprises:

(a) spraying water on to a mixture of the condensed phosphate, builder salt and an ammonium polyphosphate as a binder, and granulating the mixture, or (b) spraying an aqueous solution or suspension of ammonium polyphosphate on to the mixture of condensed phosphate and builder salt and granulating the mixture, the builder salt being used in a proportion of about 5 up to 100 weight %, the ammonium polyphosphate in a proportion of about 0.003 to 1 weight % and the water in a proportion of about 0.5 to 10 weight %, the percentages being based on the quantity of condensed phosphate.

It is preferable for the builder salts to be selected from the alkali metal salts of nitrilotriacetic acid and/or poly-α-hydroxyacrylic acid and/or polyacrylic acid, the latter having a molecular weight of about 2000 to 30 000.

The ammonium polyphosphate used in accordance with this invention corresponds to the following general formula (II)

$$H_{(n-m)+2}(NH_4)_mP_nO_{3n+1} \quad (II)$$

in which n stands for an integral average value of 3 to 1000, preferably 10 to 1000, m stands for a whole number of at most n+'and m/n corresponds to a value of 1.0 to 1.67, preferably about 1.

It is also preferable in accordance with this invention for the builder to be used in a proportion of 5 up to 50 weight %, for the ammonium polyphosphate to be used in a proportion of 0.04 to 0.4 weight %, and for the water to be used in a proportion of 2 to 9 weight %, the percentages being based on the quantity of condensed phosphate. This latter preferably contains 60.4 to 69.6 weight % $P_2O_5$.

It is finally advantageous for the water or aqueous ammonium polyphosphate solution to be sprayed intermittently in a plurality of spray steps on to the mixture, in about 2 minute intervals. After each spray step, the granulate preferably has pulverulent pentasodium triphosphate applied to its surface area.

The present invention permits abrasion-resistant, storable and non-caking mixed granulates with a considerable proportion of condensed phosphates therein to be produced. This is an unexpected result inasmuch as water has basically been held unsuitable for effecting the granulation of melt phosphates or mixtures thereof with other substances. Indeed it has long been held that water as a granulating aid would always cause coalescence of the individual melt phosphate particles to undesirable large agglomerates unless the melt phosphate were admixed with hydratable anhydrous salts preventing the melt phosphate from absorbing water. This is not true concerning the present invention wherein the use of ammonium polyphosphate as a binder has been found to render the degree of hydration of the remaining granulate components irrelevant.

The following Examples illustrate the process of this invention:

EXAMPLE 1

A pulverulent strongly hygroscopic mixture of 12.5 kg commercial melt phosphate containing 68% $P_2O_5$ and 12.5 kg sodium nitrilotriacetate was placed on a rotating plate and sprayed thereonto over altogether 10 minutes was a 4 weight % aqueous ammonium polyphosphate solution. The ammonium polyphosphate contained 72.5 weight % $P_2O_5$ and was used in a proportion of 0.6 weight %, based on the quantity of melt phosphate. A hard granulate was obtained. 93.4% of its particles had a size coarser than 150 microns. These had an abrasion resistance of 85%, determined by the drum method. The apparent density of the granulate was 650 g/l. After storage for one week in a thin-walled plastic bag permeable to moisture, just a few agglomerates which disintegrated into individual granules under minor mechanical action were found to have been formed.

EXAMPLE 2

25 kg mixture, the same as that in Example 1, was placed on a rotating plate and a 4 weight % solution of ammonium polyphosphate was intermittently sprayed thereonto. In contrast with the procedure described in Example 1, after each spray step, the mixture on the plate had pulverulent sodium tripolyphosphate, altogether 5 kg, applied to its surface area. A hard granulate was obtained. 85.6% of its particles had a size coarser than 150 microns. The granulate contained 0.1 weight % ammonium polyphosphate, based on the quantity of melt phosphate, and had an apparent density of 630 g/l. The abrasion-resistance determined by the drum method was 69%. After storage for one week under conditions the same as in Example 1, the product was found to tend to just slight agglomeration.

EXAMPLE 3

A mixture of 12.5 kg commercial melt phosphate containing 68% $P_2O_5$, 6.25 kg sodium nitrilotriacetate and 6.25 kg sodium polyacrylate with a condensation degree of 17 was placed on a rotating plate and treated, as described in Example 2, with a 4 weight % ammonium polyphosphate solution and with altogether 5 kg of fine particulate sodium tripolyphosphate. As compared with the products obtained in Examples 1 and 2, the granulate was slightly softer. 95.1% of its particles were coarser than 150 microns. The granulate contained 0.35 weight % ammonium polyphosphate, based on the quantity of melt phosphate, and had an apparent density of 625 g/l. After storage for one week under conditions the same as in Examples 1 and 2, the product was still perfectly flowable.

We claim:

1. A process for making granulates from a mixture consisting essentially of water-soluble condensed phosphates of the following general formula (I)

$$M_2O(MPO_3)_n \quad (I)$$

in which M stands for sodium, potassium or ammonium and n stands for a number between 4 and about 100, and at least one builder salt for detergent or cleaning compositions by subjecting the said mixture to granulation in the presence of water, the process which comprises the steps:

(a) carrying out the granulation with a granulation aid consisting essentially of an ammonium polyphosphate corresponding to the following general formula (II)

$$H_{(n-m)+2}(NH_4)_mP_nO_{3n+1} \quad (II)$$

in which n stands for an integral average value of 3 to 1000, m stands for a whole number of at most n+2, and m/n is between 1.0 and 1.67;

(b) selecting the builder salt from the group consisting of alkali metal salts of nitrilotriacetic acid, poly-α-hydroxyacrylic acid and polyacrylic acid, the latter having a molecular weight of about 2000 to 30 000;

(c) granulating a mixture corresponding essentially of the condensed phosphate (I), the said builder salt and the ammonium polyphosphate (II) by placing this mixture on a rotating plate and spraying water on to this mixture or granulating a mixture consisting essentially of the condensed polyphate (I) and the said builder salt by placing this mixture on a rotating plate and spraying an aqueous solution or suspension of the ammoniumpolyphosphate (II) on to the mixture;

(e) the builder salt being used in a proportion of about 5 up to 100 weight %, the ammonium polyphosphate (II) in a proportion of about 0.003 to 1 weight % and the water in a proportion of about 0.5 to 10 weight % , the percentages being based on the quantity of condensed phosphate (I).

2. The process as claimed in claim 1 wherein, in general formula (II), n stands for an integral average value of 10 to 1000 and the ratio of m/n is about 1.

3. The process as claimed in claim 1, wherein the condensed phosphate of general formula (I) contains 60.4 up to 69.6 weight % $P_2O_5$.

4. The process as claimed in claim 1, wherein the builder is used in a proportion of 5 to 50 weight %, the ammonium polyphosphate in a proportion of 0.04 to 0.4 weight % and the water in a proportion of 2 to 9 weight %, the percentages being based on the quantity of condensed phosphate.

5. The process as claimed in claim 1, wherein the water or aqueous ammonium polyphosphate solution is sprayed intermittently in a plurality of spray steps on to the mixture, in about 2 minute intervals.

6. The process as claimed in claim 5, wherein the granulate obtained after each spray step has pulverulent pentasodium triphosphate applied to its surface area.

* * * * *